United States Patent [19]

Rosenkilde

[11] 4,028,503

[45] June 7, 1977

[54] ELECTROMAGNETIC SOUND GENERATOR

[76] Inventor: Hakon Rosenkilde, Brincks Have 5, 2630 Taastrup, Denmark

[22] Filed: Aug. 4, 1975

[21] Appl. No.: 601,284

[30] Foreign Application Priority Data

Aug. 7, 1974 Denmark ..... 4189/74

[52] U.S. Cl. ..... 179/115 R; 340/388

[51] Int. Cl.² ..... G10K 9/14

[58] Field of Search ..... 259/1, DIG. 44; 340/388; 335/231; 84/1.06; 179/115 R, 114 R

[56] References Cited

UNITED STATES PATENTS

| | | | |
|---|---|---|---|
| 540,969 | 6/1895 | Field | 340/388 |
| 3,214,753 | 10/1965 | Dodge | 340/388 |

FOREIGN PATENTS OR APPLICATIONS

| | | | |
|---|---|---|---|
| 680,855 | 5/1930 | France | 340/388 |
| 363,389 | 10/1938 | Italy | 340/388 |

*Primary Examiner*—George G. Stellar
*Attorney, Agent, or Firm*—Mason, Fenwick & Lawrence

[57] ABSTRACT

A sound generator is disclosed having an armature of magnetizable material carried by a membrane fixed along its periphery to a frame carrying an alternating current electromagnetic circuit including coils and at least one pair of poles, said armature consists of an elongated tongue having one end rigidly connected near the center of said membrane, said one end being placed opposite and at a distance from one pole face and having a free end placed opposite and at a distance from the other pole face and at a distance from said membrane.

8 Claims, 11 Drawing Figures

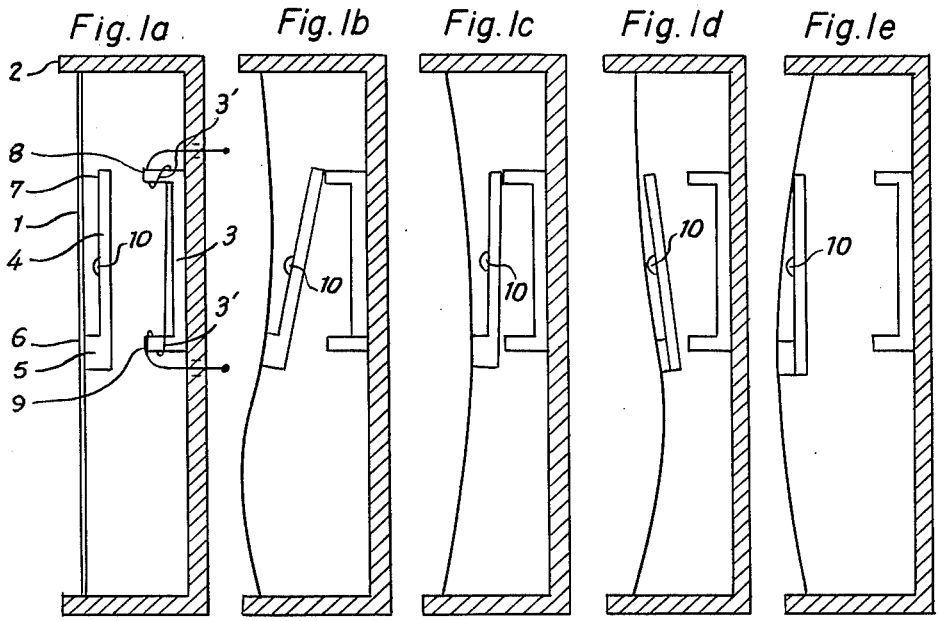
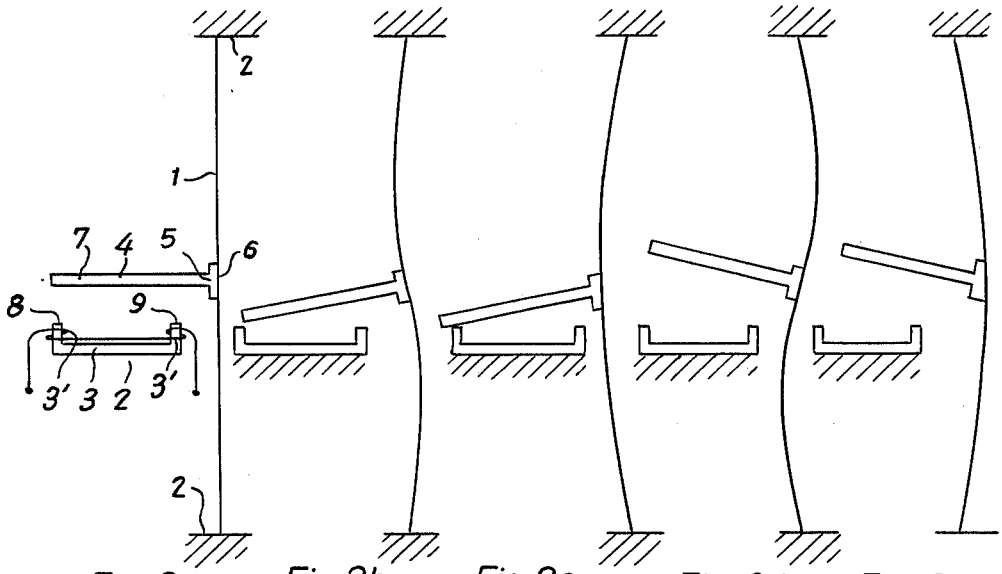
Fig. 2a Fig. 2b Fig. 2c Fig. 2d Fig. 2e
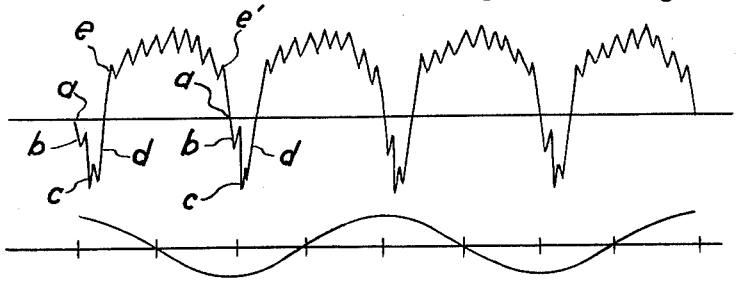
Fig. 3

ELECTROMAGNETIC SOUND GENERATOR

It is the purpose of the invention to devise the construction of a sound generator of the above-mentioned type which is adapted to produce a particularly strong sound intensity in relation to the relatively small dimensions of the sound generator and the electrical effect supplied and within a broad frequency range.

A sound generator according to the invention includes a membrane being fixed along its periphery to a frame carrying an electromagnetic circuit, an armature fastened to the membrane and the coils of which can be connected to an A.C. source, wherein the membrane has small stiffness and the armature includes an elongate tongue made from magnetizable material. The tongue has its end part stiffly connected to the membrane near the centre thereof, and its free end part extending parallel to the pole faces of the electromagnetic circuit at a distance from said faces. Hereby is obtained — when the A.C. source is connected to the coils of the electromagnetic circuit — that the sound intensity is increased by a comprehensive interaction between the pivoting movement of the tongue about the nodal line of the membrane lying perpendicular to the tongue's movements and said translatoric movements of the tongue and of the membrane towards and away from the pole faces, which movements are substantially synchronous with the two maximum values of the A.C. and are only limited by the mechanical stresses in the membrane and possibly by the tongue's hitting against the pole faces.

An embodiment of the sound generator according to the invention has the added feature in that the tongue on its surfaces facing the membrane is provided with a knob protruding from said surface. Hereby is obtained that the protruding knob — which has a suitable height perpendicular to the surface of the tongue — exerts a pressure on the membrane and increases the speed velocity of the membrane and accelerates the tongue's pivoting movement towards at least one of the pole faces. An amended embodiment of the sound generator has the added feature in that the pole faces of the electromagnetic circuit are lying on a plane forming a right or almost right angle with the plane of the membrane.

The invention will be further described below with reference to the drawing, where FIGS. 1*a* to 1*e* schematically show a section through the centre of the membrane in the sound generator and through the longitudinal axis of the tongue in five different positions in the movement of the membrane between its two outer positions.

FIGS. 2*a* to 2*a* corresponding sections in an amended embodiment of the sound generator, and FIG. 3 an oscillogram showing the translatoric movement of the centre of the membrane perpendicular to its plane and a corresponding current curve for the A.C. supplied.

On the FIGS. 1*a*–1*e* and 2*a*–2*e*1 is a membrane of thin, preferably non-magnetic material with small stiffness, e.g. of 0.05 mm thick sheet bronze which along its circular, rectangular or guadratic circumference is secured to a mechanically stiff frame 2 carrying an electromagnetic circuit 3, the coil or coils 3' can be connected to an A.C. source (not shown) e.g. with 50 Hz. The armature 4 being shaped as a longitudinal tongue the one end part 5 of which being stiffly connected to the membrane 1 nearby the geometrical centre 6 of the membrane and extending with its free end part 7 parallel to the pole faces 8 and 9 respectively of the electromagnetic circuit 3 in a suitable distance from these faces. On FIG. 1*a* the membrane 1 is shown in its starting position corresponding to a point *a* in the oscillogram on FIG. 3, when the A.C. is connected. At first the tongue 4 will pivote about its end part 5 being stiffly connected in the membrane 1, the membrane 1 bending about its nodal line lying perpendicular to the tongue's fulcrum and running through the centre 6 of the membrane, the one semi-part of the membrane being bent in direction towards the electromagnetic circuit, while its second semi-part is bending in direction away from same. The movement of the tongue's free end part 7 is stopped by the mechanical stresses generated in the membrane or possibly by the impact of the end part 7 against the pole face 8, which is shown at a point *b* on the oscillogram corresponding to FIG. 1*b*. A slight backward movement at the point *b* in the oscillogram FIG. 3 of the centre 6 of the membrane indicates the rebound of the end part 7 against the pole face 8. Then the fixed end part 5 of the tongue is drawn — by increasing magnetic attraction — with great velocity towards the pole face 9 due to steadily diminished distance between the tongue 4 and the pole face 9 as far as the mechanical stresses generated in the membrane allow, possibly until the end part 5 hits the pole 9 as shown at a point *c* on FIG. 3, at the same time the membrane 1 is changing into the position shown on FIG. 1*c*, where it is tightened into an arc between its fixing points in the frame 2 and with summit in its centre 6. A slight backward movement in the oscillogram FIG. 3 at the point *c* indicates the rebound of the end part 5 against the pole face 9. The abrupt movement of the centre of the membrane towards the pole face 9 and possibly the stroke against this face causes that the tongue 4 and consequently the membrane 1 change direction of motion and with great velocity are forced away from the pole faces 8 and 9, after which the membrane — through an intermediate position shown on FIG. 1*d* and indicated in the oscilogram at a point *d* — is transferred to another extreme position which is shown on FIG. 1*e* and the point *e* on FIG. 3, which extreme position is determined by the mechanical stresses generated in the membrane and by the mass action of the tongue, and in this position the membrane produces a number of free oscillations, as shown between the point *e* and a point *e'*, where the maximal magnetic power again actuates the tongue 4 and the membrane 1 in direction towards the pole faces 8 and 9, after which a periodically repeated movement with the double frequently of the impressed A.C. voltage is continued — as shown on FIG. 3 — as long as the A.C. is connected to the coils 3'.

The periodic oscillations which are carried out with great velocity produces a particularly strong sound intensity compared to the relatively small dimensions of the sound generator and the A.C. effect impressed. Experiments with prototyes of the generator with membrane sizes of approx. 6 × 7 cm have shown that a supplied effect of 2–3 volt-ampere gives a very piercing signal tone with a strong content of overtones coming from the free oscillations of the membrane in the positions shown on FIG. 1*e*. Such a sound generator can be manufactured in mass production at a reasonable price and it will be suitable for outdoor use, e.g. as horn for moped bikes.

If the effect is increased to approx. 6 volt-ampere, the signal tone is nearly unbearable to the ear, especially due to the membrane's stroke against the pole faces and also the content of overtones is essentially increased. It is an advantage that the generator does not contain electrical switches and is working without polarization and having frequency doubling. The generator can be driven with frequencies from 16 Hz up to approx. 200 Hz.

On FIGS. 2*a*–2 *e* is shown an embodiment f the signal generator according to the invention where the electromagnetic circuit 3 is located with its pole faces 8 and 9 in a plane substantially perpendicular to the plane of the membrane 1. The function of this signal generator is in all essentials as described above with reference to FIGS. 1*a*–1*e*, and titles and reference numerals are the same as used in said figures. For the sake of clearness the securing of the membrane 1 and the electromagnetic circuit 3 is only indicated by the signature for fixed connection to the frame 2.

It will be understood by a person skilled in the art that the pole faces 8 and 9 in FIGS. 1*a*–1*e* as well as in FIGS. 2*a*–2*e* appropriately can be tilted in relation to the tongue's initial position, so that they are both hit simultaneously by the tongue in its attracted position. The pole face 9 may even with advantage be displaced in such a way that it is hit later than the pole face 8, whereby the translatoric movements of the membrane can be increased and consequently also the sound intensity.

The sound generator shown on FIGS. 2*a*–2*e* may be dimensioned to produce a less enervating sound intensity, e.g. for indoor use for replacement of the common bells, compared to which there will be obtained a great reliability and low cost due to the simple and sturdy construction of the signal generator and the omission of the electrical vibrator switch and the bells which must often be adjusted.

In an embodiment of the signal generator according to the invention the tongue 4 may, on its surface facing the membrane 1, be provided with a knob 10 having a suitable height and protruding from said surface and which is co-operating with the membrane 1 in a fraction of its movements as shown on FIGS. 1*d* and 1*e* for accelerating the movements of the membrane and of the tongue, respectively.

What I claim is:

1. An electromagnetic sound generator comprising a frame, a membrane with the periphery thereof fixed to the frame and having an axis, an electromagnetic actuation means mounted on the frame for applying a cyclical force to the central portion of the membrane relative to its periphery and bending one portion of the membrane in a direction towards the elctromagnetic circuit and the other portion in a direction away from same, thereby providing a sound generator in which the sound intensity is increased by the interaction between the bending of the membrane and translation of the central portion of the membrane.

2. The electromagnetic sound generator of claim 1 wherein the actuation means includes at least two pole faces on the frame, said pole faces being unsymmetrically disposed with respect to the membrane, an armature fastened to the membrane, a coil means mounted adjacent the pole faces on the the frame and activated by a fluctuating current source for changing the magnetic fields at the pole faces of the frame, said armature including an elongated tongue formed of a magnetic material, said tongue having an end fixed to the membrane near the center thereof and having a portion of the tongue extending parallel to the pole faces of frame and spaced apart from said faces and said membrane.

3. The electromagnetic sound generator of claim 2 wherein the tongue additionally includes a knob projecting from the tongue and toward the membrane.

4. The electromagnetic sound generator of claim 2 wherein the pole faces are positioned in a plane generally perpendicular to the membrane.

5. The electromagnetic sound generator of claim 2 wherein the pole faces are positioned in a plane generally parallel to the membrane.

6. The electromagnetic sound generator of claim 1 wherein the actuation means includes at least two pole faces on the frame, an armature fastened to the membrane, and coils mounted on the frame and connectable to an alternating current source, the armature having an elongate tongue formed of magnetizable material, said tongue connected to the membrane near the center hereof and having a free end portion extending parallel to the pole faces of the electromagnetic circuit at a distance from said faces.

7. The electromagnetic sound generator of claim 6, including a knob protruding from the tongue on its surface facing the membrane.

8. The electromagnetic sound generator of claim 6, wherein the pole faces are positioned in a plane generally perpendicular to the membrane.

* * * * *